US006016576A

United States Patent [19]

Happe

[11] Patent Number: 6,016,576

[45] Date of Patent: Jan. 25, 2000

[54] TOILET ODOR REMOVAL SYSTEM

[76] Inventor: Arthur E. Happe, 4619 New Harmony Rd., Evansville, Ind. 47720

[21] Appl. No.: 09/348,596

[22] Filed: Jul. 6, 1999

Related U.S. Application Data

[60] Provisional application No. 60/091,770, Jul. 6, 1998.

[51] Int. Cl.[7] ..... E03D 9/04

[52] U.S. Cl. ..... 4/213; 4/217

[58] Field of Search ..... 4/213, 216, 217, 4/347–352

[56] References Cited

U.S. PATENT DOCUMENTS

| | | | |
|---|---|---|---|
| 3,277,499 | 10/1966 | Keefauver | 4/213 |
| 3,887,949 | 6/1975 | Osmond | 4/213 |
| 4,125,906 | 11/1978 | Weiland | 4/213 |
| 4,222,129 | 9/1980 | Baker | 4/213 |
| 4,301,555 | 11/1981 | Poister | 4/213 |
| 4,617,687 | 10/1986 | Wadsworth | 4/213 |
| 4,620,329 | 11/1986 | Wix | 4/213 |
| 4,748,698 | 6/1988 | Kao | 4/213 |
| 4,984,310 | 1/1991 | Casale | 4/213 |
| 5,136,730 | 8/1992 | Casale | 4/213 |

*Primary Examiner*—Charles R. Eloshway
*Attorney, Agent, or Firm*—George H. Morgan

[57] ABSTRACT

A system for removing odorous vapors from a commode which comprises a modified toilet seat and hinge arrangement including a vacuum inducing fan arrangement. The present invention uses a switch that is isolated from the power supply to a fan so only 12 volts DC electricity and 300 milliamps of current is transmitted through the switch connecting wiring within the toilet seat.

7 Claims, 14 Drawing Sheets

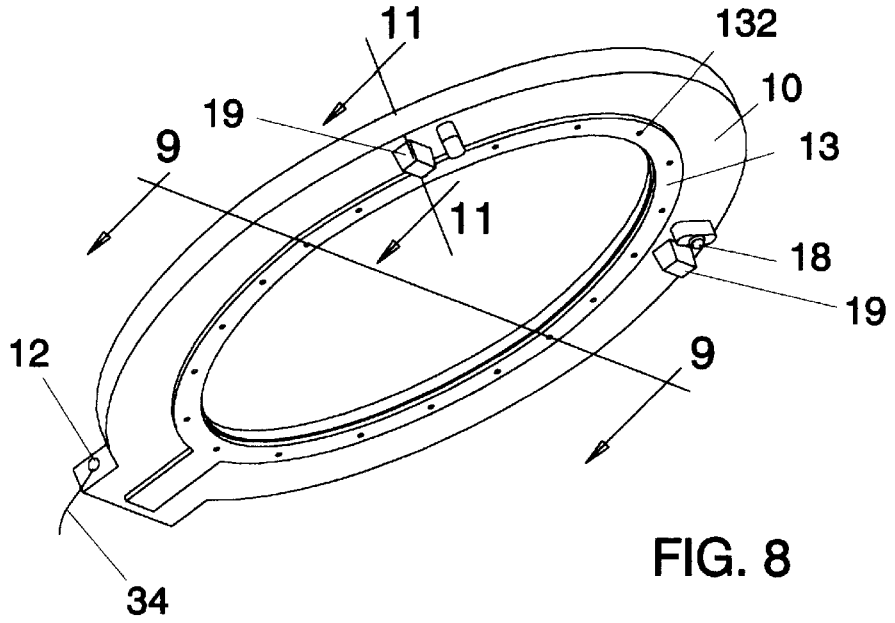
FIG. 8
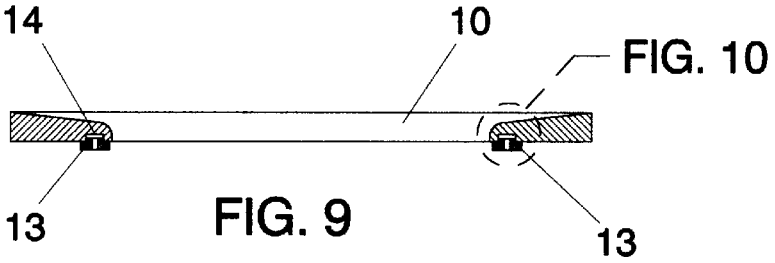
FIG. 9
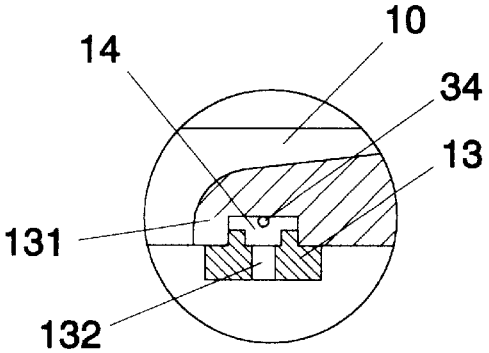
FIG. 10
FIG. 11
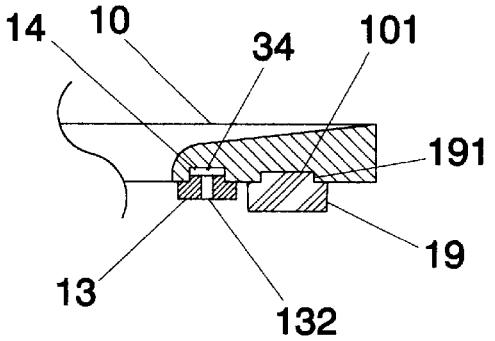

FIG. 19
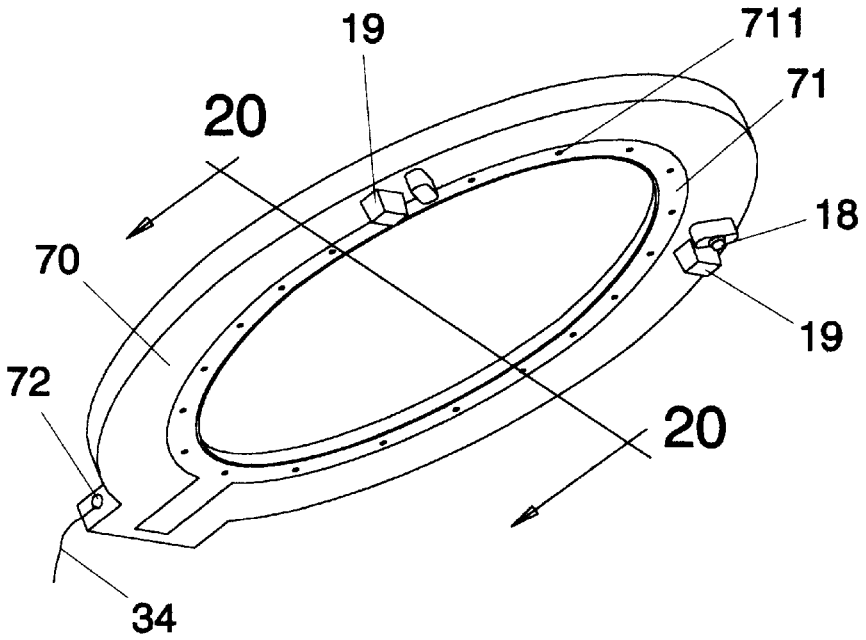
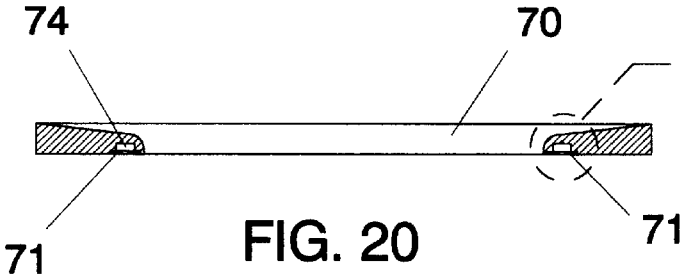
FIG. 21
FIG. 20
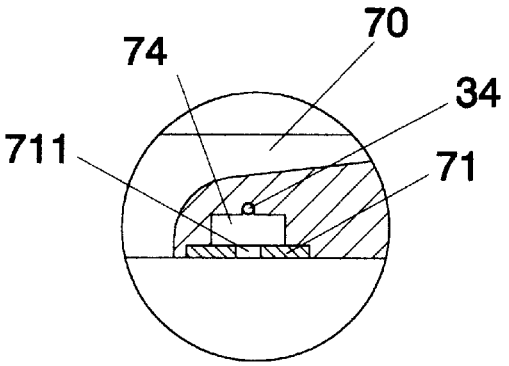
FIG. 21

FIG. 27
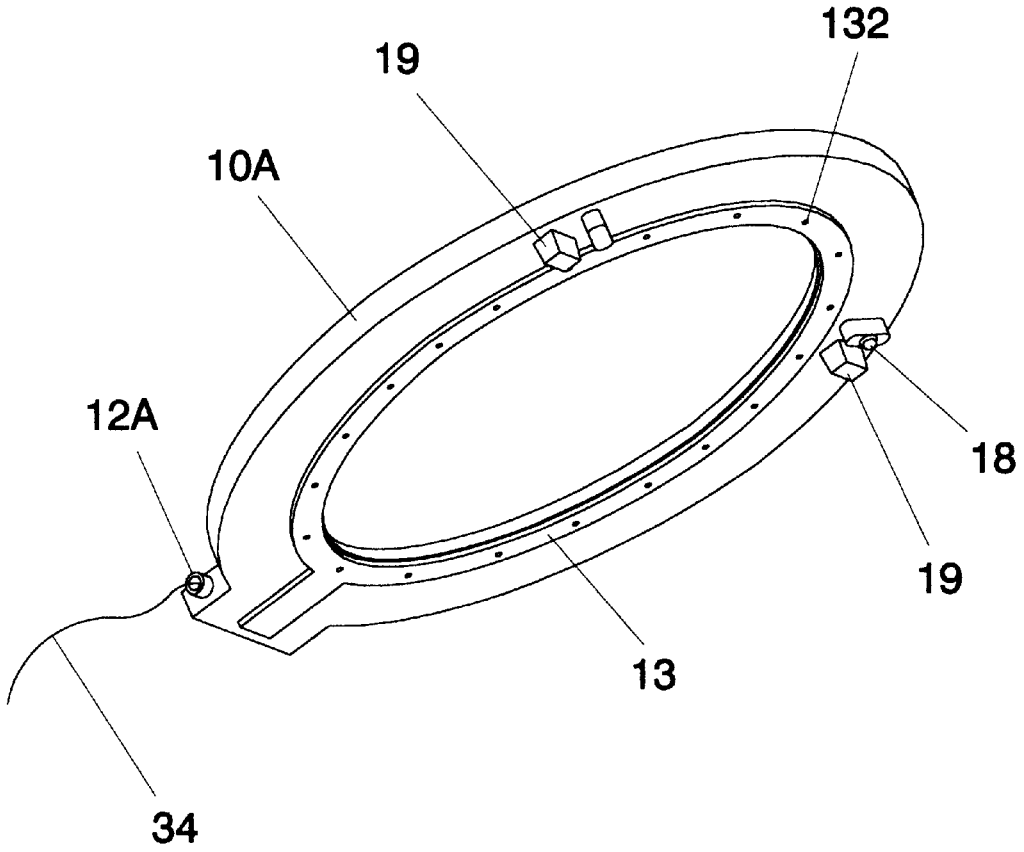
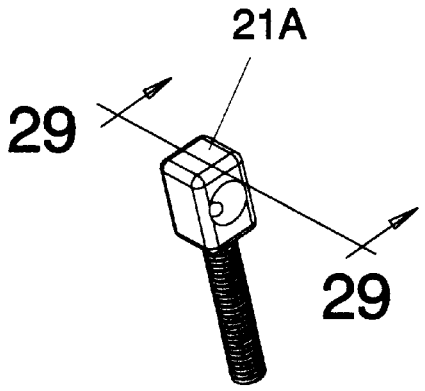
FIG. 28
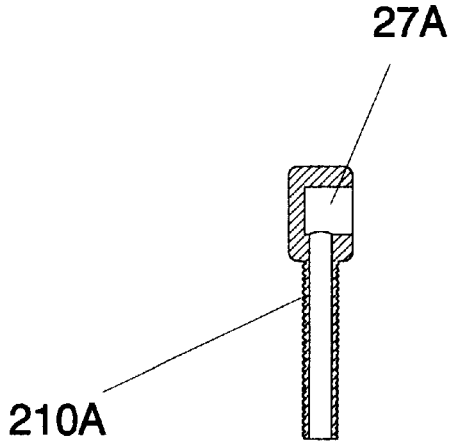
FIG. 29

TOILET ODOR REMOVAL SYSTEM

CROSS REFERENCES TO RELATED APPLICATIONS

Provisional Application for Patent 60/091,770 filed Jul. 6, 1998 with the same title as above, "Toilet Odor Removal System". Applicant claims priority pursuant to 35 U.S.C., Par. 119(*e*)(i) for said Provisional Application. The applicant incorporates, by reference, said Provisional Application for Patent into the specification of this application in its entirety.

Statement as to Rights to inventions made under Federally sponsored research and development Not applicable

BACKGROUND OF THE INVENTION

1. Field of the Invention

This invention relates to a system for exhausting noxious vapors from a toilet through an improved toilet seat with an exhaust fan that is automatically actuated at the time a person sits on th e toi let seat.

2. Background Information

From an electronic search of the U. S. Patent Office files the following patents were discovered:

U.S. Pat. No. 4,165,544, Aug. 28, 1979, Barry

U.S. Pat. No. 4,175,293, Nov. 27, 1979, Stephens et al

U.S. Pat. No. 4,232,406, Nov. 11, 1980, Beeghly et al

U.S. Pat. No. 4,251,888, Feb. 24, 1981, Turner

U.S. Pat. No. 4,556,999, Dec. 10, 1985, Liedley

U.S. Pat. No. 4,726,078, Feb. 23, 1988, Carballo et al

U.S. Pat. No. 5,010,600, Apr. 30, 1991, Prisco

U.S. Pat. No. 5,136,729, Aug. 11, 1992, Ricard

U.S. Pat. No. 5,161,262, Nov. 10, 1992, Quaintance,Sr.

U.S. Pat. No. 5,191,111, Apr. 6, 1993, Antepenko

U.S. Pat. No. 5,590,423, Jan. 7, 1997, Boykin

This seems to be a crowded art. However, the above systems are prone to contamination yet difficult to clean. This is an unsanitary situation. Also, most lack automatic operation with delayed shut off. A person has to actuate the systems, and often people forget when it is inconvenient to reach over and actuate a switch.

Barry, U.S. Pat. No. 4,165,544 is significant in that it uses a vacuum drawn from through a modified water tank. It would seem that the operation of the odor removal apparatus, at times, conflicts with the flushing operation.

Stephens et al., U.S. Pat. No. 4,175,293 uses a special hinge which requires an off standard seat and cover. Again, this requires mass production to be cost effective. Also, it is only collecting odors at one end of the commode seat and requires more space than other approaches.

Beeghly et al, U.S. Pat. No. 4,232,406, tries to overcome the problems of Barry with a vacuum breaker valve. This involves a water tank designed for the application. This involves a deviation from the standard water tanks which complicates manufacturing, distribution, installation, and pricing.

Turner, U.S. Pat. No. 4,251,888, uses a customised commode seat that is complex to manufacture. Also, water will tend to collect inside the hollow spaces in the seat. The hollow spaces are difficult, if not impossible, to clean out. Also, there are household voltage electrical connections directly under the water tank. Commodes can overflow in certain circumstances so those electrical connections could be flooded with water. Also, many people are not that comfortable sitting in the vicinity of electrical connections at 110 volts AC with their private parts uncovered. That is a customer acceptance problem.

Lindley, U.S. Pat. No. 4,556,999, also uses a commmode seat with hollow spaces that can collect moisture and are difficult, if not impossible, to clean. Also, this is an expensive seat to manufacture because of the tooling costs involved for economical production.

Carballo et al., U.S. Pat. No. 4,276,078 also has the problem of a specialized commode seat, difficult to manufacture, with spaces that will collect moisture and be difficult, if not impossible, to clean.

Prisco, U.S. Pat. No. 5,010,600, also has the problem of a specialized commode seat, difficult to manufacture, with hollow spaces that will collect moisture and be difficult, if not impossible, to clean.

Ricard, U.S. Pat. No. 5,136,729, is an extra part in a toilet bowl assembly that would seem to be an additional item to keep clean. It primarily addresses the odious vapors in a localized area of the toilet bowl.

Quainance,Sr., U.S. Pat. No. 5,161,262, has a rather conspicuous piece of added hardware that would appear to be a cleaning chore.

Anatepenko, U.S. Pat. No. 5,199,111, has the advantage of retrofit on existing toilet bowls, but it appears to deal primarily with vapors near the one end of the bowl and appears to be difficult to keep clean. Men can be sloppy urinaters, and that is a problem with projecting hardware such as is illustrated in U.S. Pat. No. 5,199,111.

Boykin, U.S. Pat. No. 5,590,423, is an extra assembly, takes up space, and would apear to be difficult to keep clean. Boykin addresses a mommentary contact switch that may be connected in series with the power supply line of the venting system that activates the venting system when a person sits on the seat of the commode. This implies that the full current required to operate the venting system is passing through said contact switch. This is a hazardous situation.

None of the above provide an easily maintainable, relatively inconspicuous, easy to manufacture, approach to removing odious vapors from a toilet bowl. As will be seen from the subsequent description, the preferred embodiment of the present invention overcomes these and other shortcomings of the prior art.

SUMMARY

The present invention is a system for removing odorous vapors from a toilet bowl which comprises a modified toilet seat and hinge arrangemnet including a means of automatically actuating a vacuum inducing fan arrangement. The present invention uses a switch that is isolated from the power supply to a fan so only 12 volt DC electricity, and 300 milliamps of current is transmitted through the switch connecting wiring within the toilet seat. The present inveniton has at least one standoff to prevent switch activation unless sufficient weight is applied to said toilet seat. The standoff also prevents the switch from damage from impact loads.

BRIEF DESCRIPTION OF THE DRAWINGS

FIGS. 8, 9, and 10 illustrate the seat with cover ring.

FIGS. 11 illustrates a rubber standoff.

FIGS. 19, 20, and 21 illustrate a second alternate embodiment seat assembly.

FIGS. 27, 28, and 29 illustrate details of the alternate embodiment seat assembly of FIG. 26.

DESCRIPTION OF THE PREFERRED EMBODIMENTS

Figure 1:
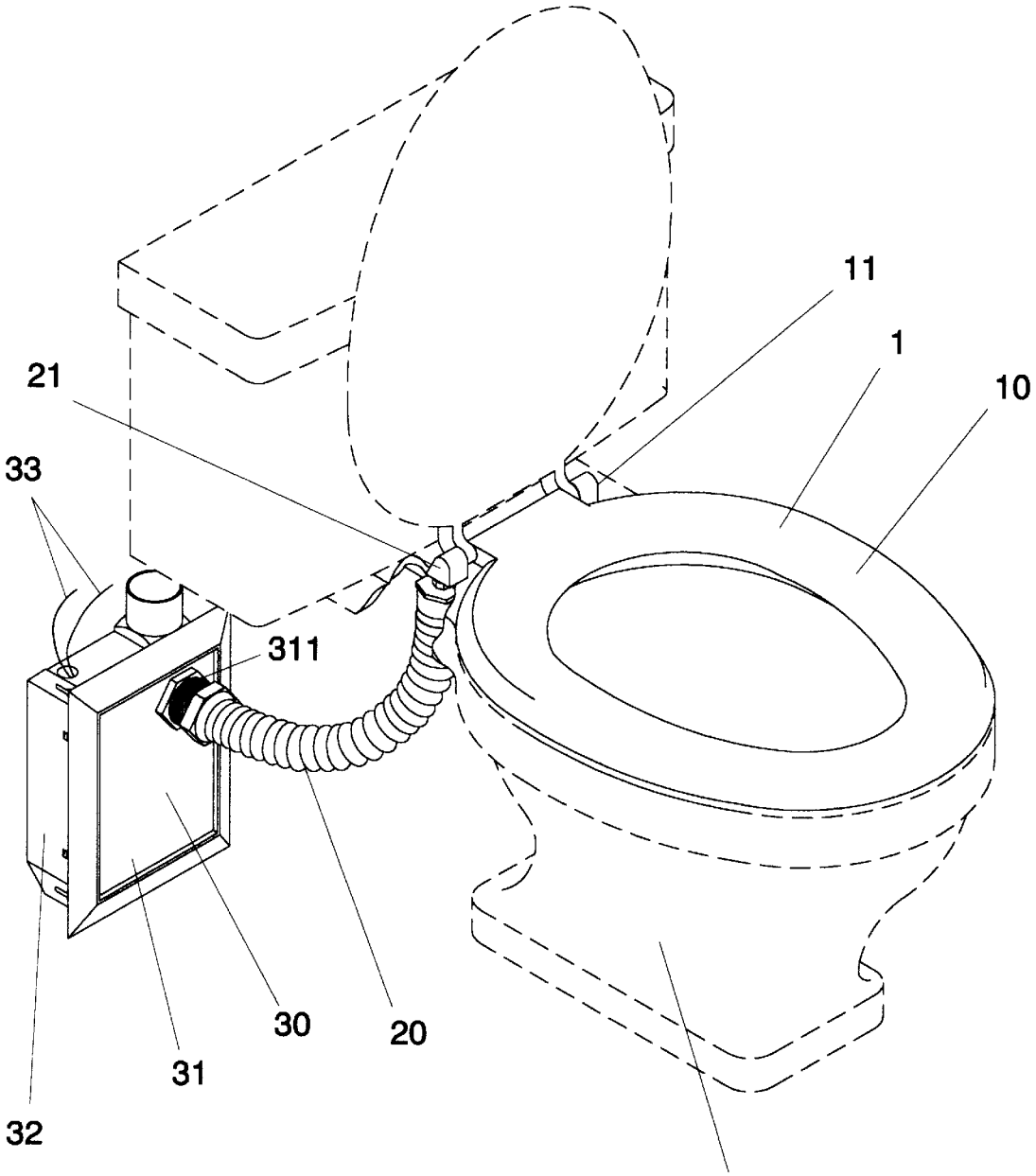
FIG. 1 illustrates a prior art commode with the present invention.

FIG. 1 illustrates the preferred embodiment of the present invention, a toilet odor removal system 1, applied to a prior art commode 40, shown in dotted lines. The toilet odor removal system 1 comprises a toilet seat 10, a seat mount 11, a hollow seat mount 21, an exhaust fan unit 30, and exhaust hose 20, and an exhaust fan unit 30.

Figure 12:
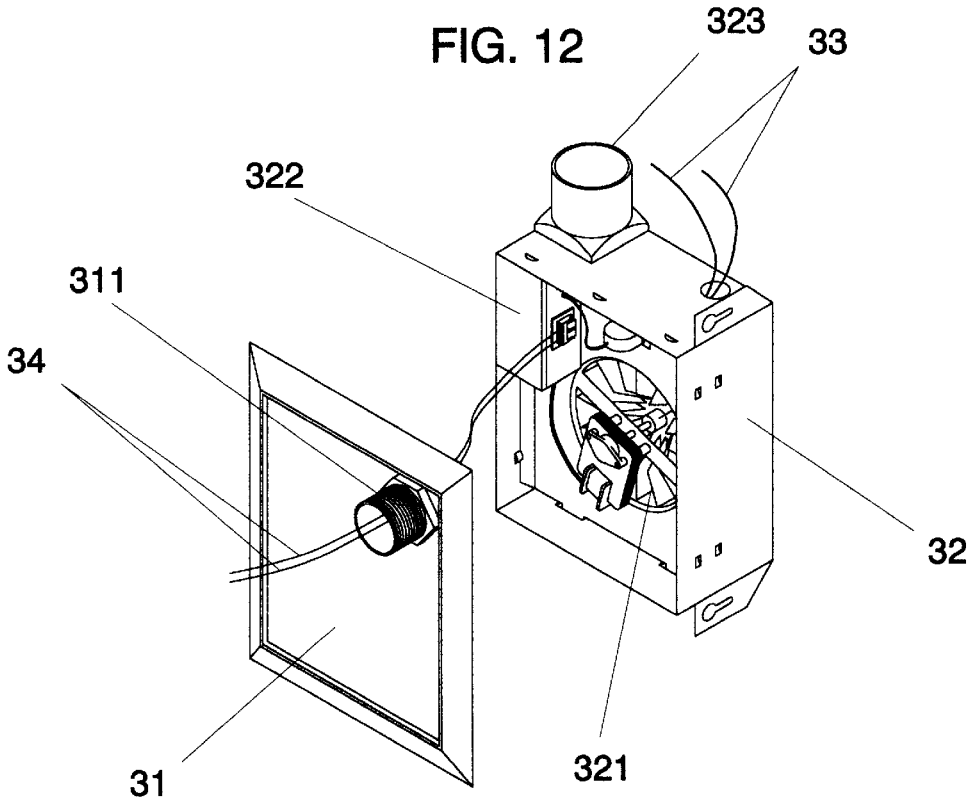
FIG. 12 illustrates fan details.

As shown in FIGS. 1 and 12, the exhaust fan unit 30 comprises a cover plate 31, a fan housing 32, electrical power wiring 33, switch connecting wiring 34, an exhaust hose connector 311, an actuation and delay module 322, an exhaust vent 323, and a fan 321.

Figure 7:
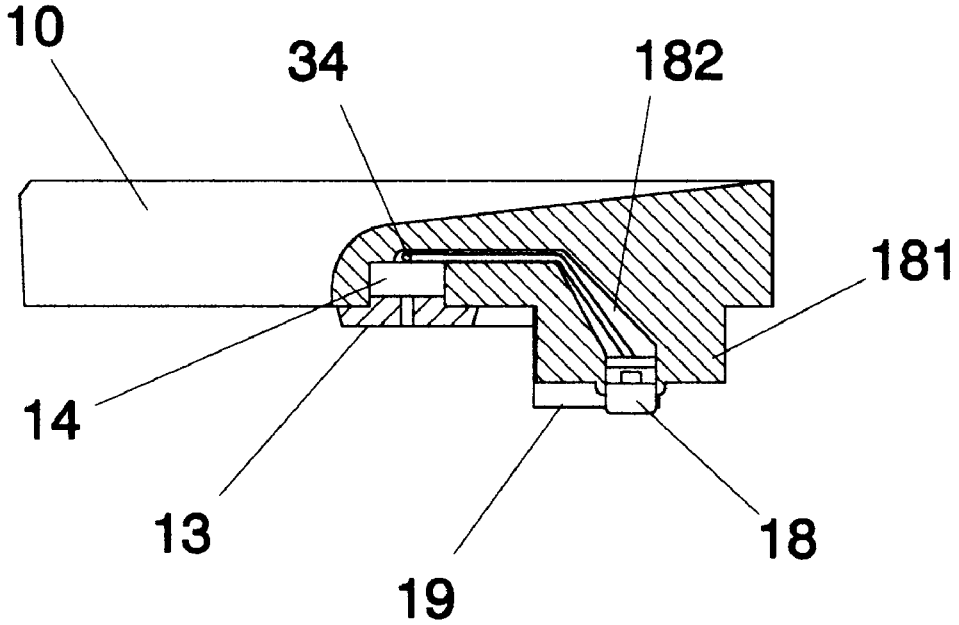
FIG. 7 shows a switch in the seat.
Figure 13:
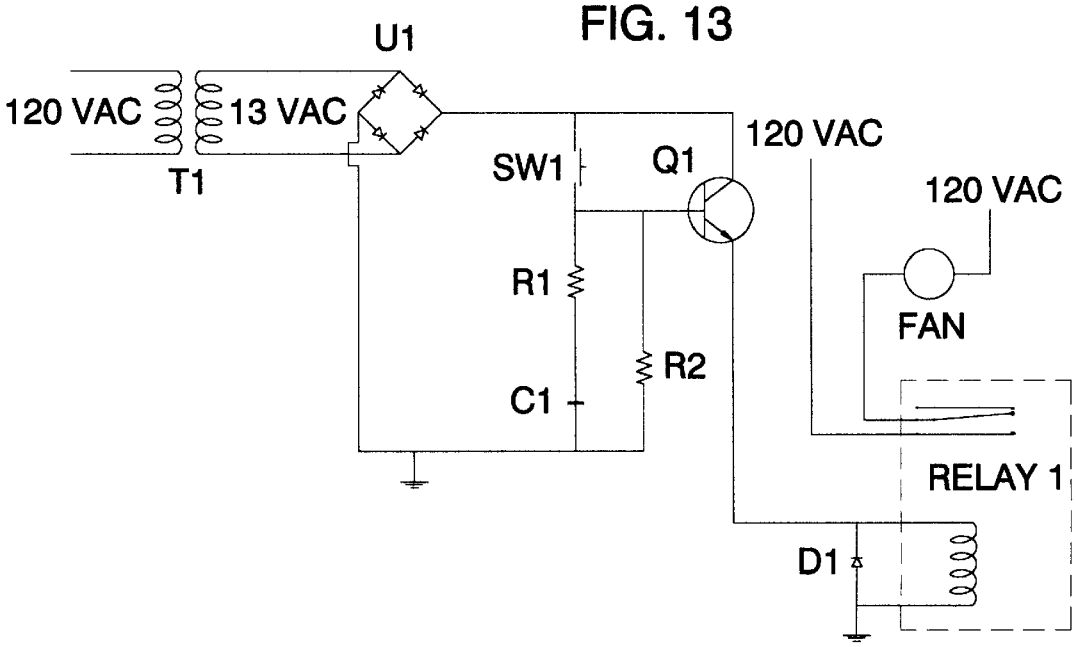
FIG. 13 is a circuit diagram for operation of the present invention with 120 volt AC household electricity.

The circuit diagram for activating the fan 321 off a 120 volt AC household electrical supply is shown in FIG. 13. The SW1 is a single pole, single throw momentary push button switch that is shown in FIG. 7 as switch 18 installed in said seat 10. When said seat 10 is depressed with sufficient weight to close switch 18, the fan 321, which is an electrically powered fan, begins operation. When said sufficient weight is removed from the seat 10, the fan 321 continues to operate for a period of time afterwards. The electrical supply to the seat 10 is isolated from said 120 volt AC household electrical supply by a RELAY 1.

All power through the switch 18 is at approximately 12 volts DC or less and lower than 300 milliamps.

In FIG. 13, a power supply section is comprised of a transformer shown as T1 which steps the 120 volt AC household electrical supply down to approximately 13 volts AC. A bridge rectifier U1 converts the approximately 13 volts AC to approximately 12 volts DC.

When SW1, i.e. switch 18, is closed, current is applied to the base of the transister Q1 allowing current flow across a collector-emitter junction of said transister Q1. This current actuates a normally open RELAY 1 that controls the 120 volt AC fan 321, shown in FIG. 12. Simultaneously, current is allowed to pass through a resister R1 and be applied to a positive plate of a capacitor C1. The capacitor C1 stores the charge on said positive plate of C1 which is built up from the current flow, until a saturation level as allowed by the capacitance of C1 is reached.

When SW1, i.e. switch 18, is opened, as when happens with the removal of said sufficient weight on seat 10 to actuate SW1, the charge stored in capacitor C1 is allowed to discharge through a resistor R2. This causes a positive potential to be maintained at the base of said transistor Q1, allowing current flow through said collector-emitter junction of said transistor Q1 to continue. When the stored charge in capacitor C1 goes below the level required to maintain the current flow in the transistor Q1, said transistor Q1 acts like a switch that is turned off and causes said RELAY 1 to stop passing 120 volts AC to the fan 321. Effectively, this has caused a delay in the fan 321 being turned off after said sufficient weight to actuate SW1 has been removed from the seat 10. A diode D1 is shown which dampens a release pulse generated by the relay R1 when the relay R1's coil is de-energized.

The delay obtainable is a variable based on the actual values of the resistor R2 and the capacitor C1.

In the preferred embodiment of the present invention, R1 is 10,000 ohms, R2 is 2.2 million ohms, C1 is 1000 uf, Q1 is a Radio Shack 2n2222 transistor, and the diode D1 is a Radio Shack part number 1N914. In the preferred embodiment of the present invention with the aforementioned electrical values, the delay obtainable is approximately 2 minutes.

An advantage of the circuit shown in FIG. 13 is that when a person sits on said seat 10 actuating the switch 18 which actuates the toilet odor removal system 1, all power to said switch 18 in said seat 10 is approximately 12 volts DC or less with a current of 300 milliamps or less. This is a marked improvement in safety over Boykin and Turner discussed in the background information. Also, once a person gets off said seat 10, there is a delay before the fan 321 ceases operation and the toilet odor removal system 1 is no longer in operation. This also is an advantage over the prior art of Boykin discussed in the background information.

Figure 2:
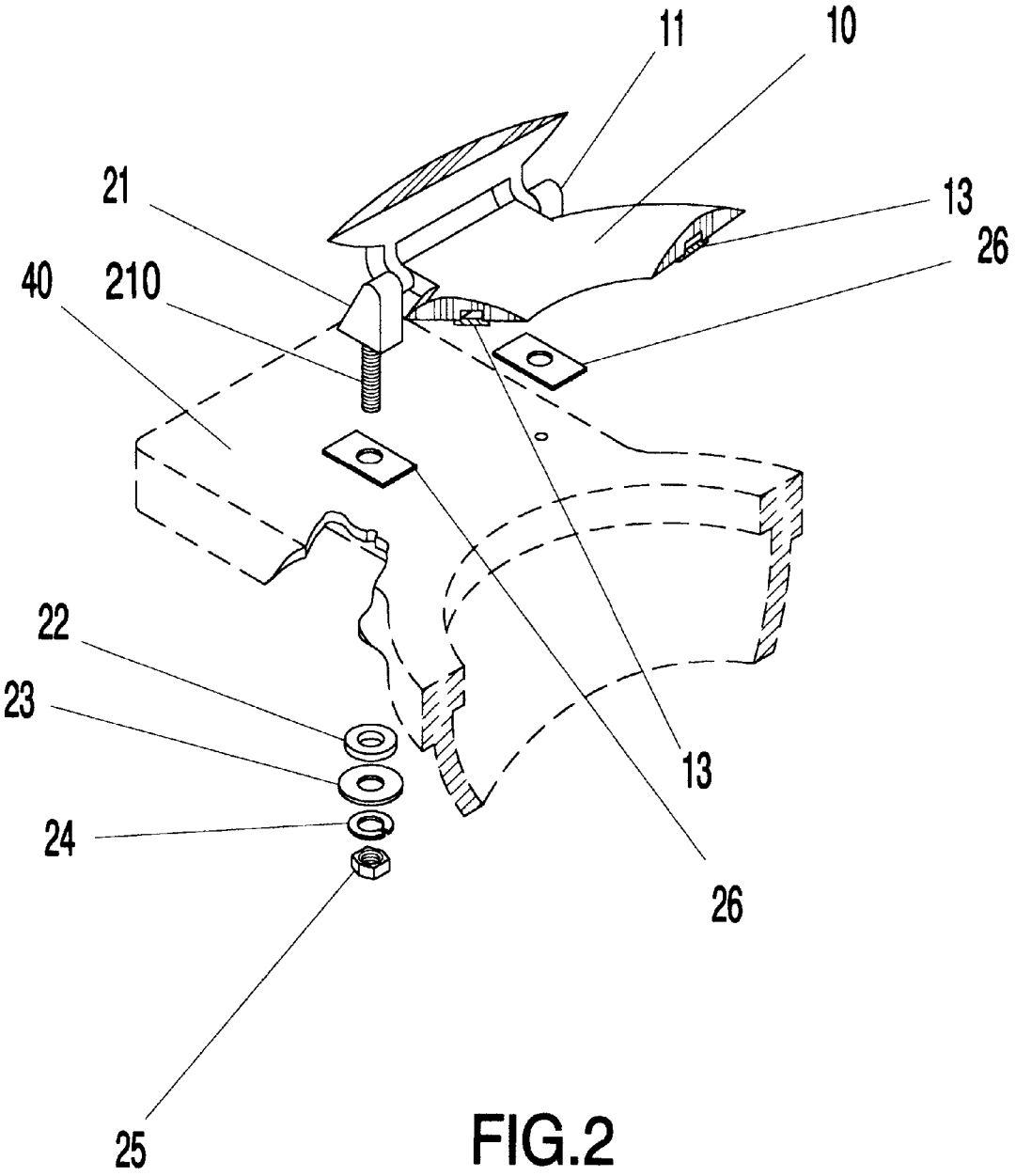
FIG. 2 illustrates details of installation of the present invention.

FIG. 2 illustrates installation details of the seat 10 on a prior art commode 40. The hollow seat mount 21, as well as the seat mount 11 are inserted through the rubber footings 26 and through said commode 40. Each of the mounts 21 and 11 are secured by a nut 25 in conjunction a rubber washer 22, a steel washer 23, and a lock washer 24 between said commode 40 and said nut 25.

As shown in FIG. 2, the toilet odor removal system further comprises a cover ring 13.

Figure 3:
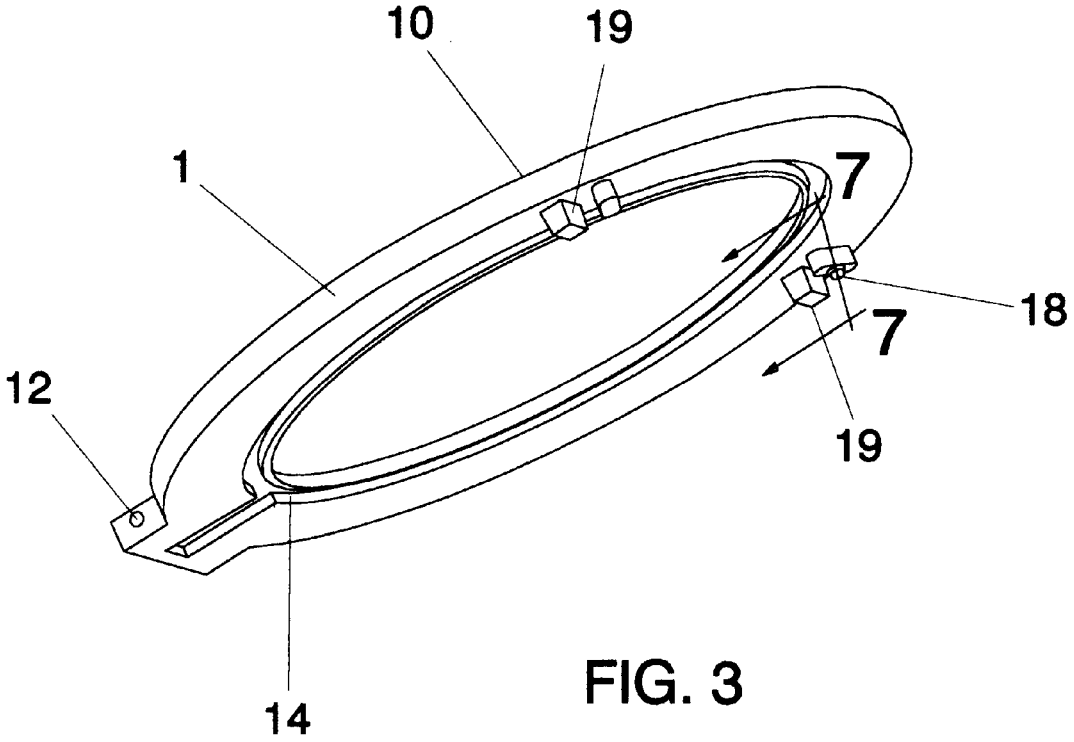
FIG. 3 illustrates a seat.
Figure 4:
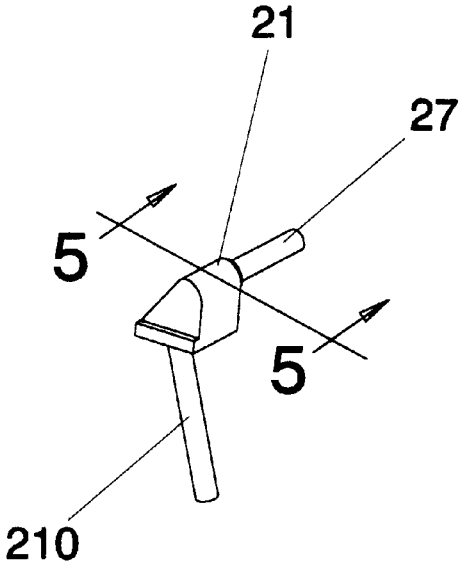
FIGS. 4 and 5 illustrate a seat mount.
Figure 5:
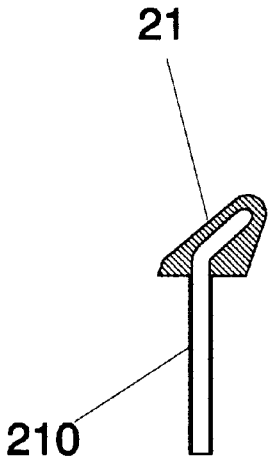

FIGS. 2, 4, and 5 show the hollow seat mount 21 which comprises a hinge tube 27, and a threaded mount tube 210. Said tubes 27 and 210 in conjunction with a vacuum channel 14, shown in FIG. 3, and the exhaust fan unit 30 and the exhaust hose assembly 20, shown in FIG. 1, permit air flow through intake ports 132, shown in FIG. 8, of the cover ring 13, shown in FIGS. 13 and 8, through said vacuum channel 14, said air flow acting to remove noxious vapors from the commode 40. The cover ring 13 with the intake ports 132 is located in said toilet seat 10 so, when the toilet seat 10 is lowered, the intake ports 132 are positioned inside of an inner rim of the commode 40 for easy draft for removing noxious odors from said commode 40.

FIG. 3 illustrates the toilet seat 10 comprising an exhaust, hinge, and wiring clearance and the aforementioned vacuum channel 14, rubber standoffs 19, and switch 18.

Figure 6:
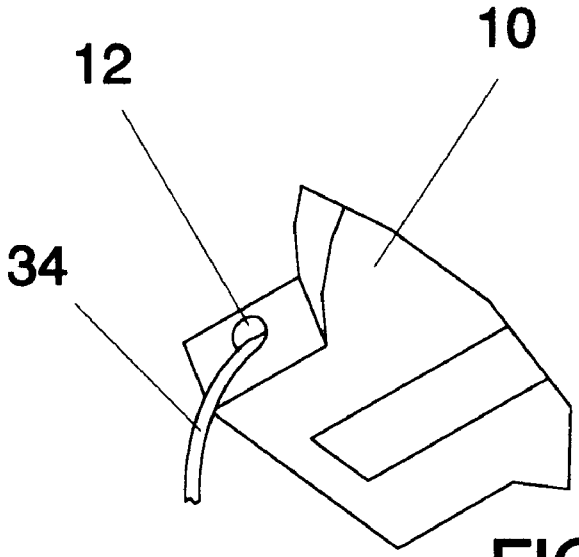
FIG. 6 shows a seat wiring detail.

FIGS. 6 and 7 illustrate the switch connecting wiring 34 entering into the exhaust, hinge, and wiring clearance 12 of said toilet seat 10, where it goes within the channel 14 through said seat 10 through a transition channel 182 to said switch 18 which is recessed into a modified standoff 181 what is typical of molded toilet seats. Said toilet seat 10 was machined from a purchased toilet seat that came with molded standoffs. FIG. 7 also shows the cover ring 13 and one of the rubber standoffs 19.

FIG. 8 is an illustration of said toilet seat 10 with the cover ring 13 with the intake ports 132. Also shown is the exhaust, hinge, and wiring clearance 12 with the switch connecting wiring 34, the rubber standoffs 19, and said switch 18.

FIGS. 9 and 11 are cross-section views taken from FIG. 8. FIG. 10 is an enlargement of a section from FIG. 9. FIGS. 9, 10, and 11 show said cover ring 13 with said intake ports 132, said channel 14, a press fit area of said toilet seat 10 into which said cover ring 13 is pressed into said seat 10, the rubber standoff 19 with a mount extrusion 191 pressed into a mount recess 101, and the switch connecting wiring 34.

Figure 14:
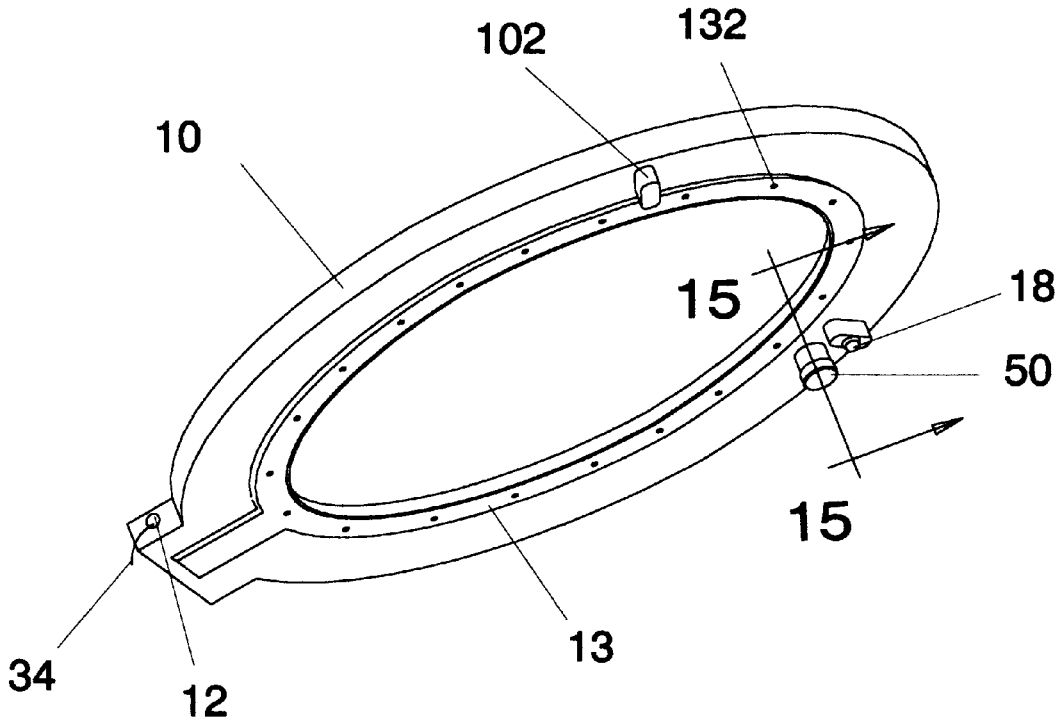
FIGS. 14 and 15 illustrate a spring style standoff.

FIG. 14 is a view of the toilet seat 10 with the exhaust, hinge, and wiring clearance 12 with a molded standoff 102 and spring style standoff 50. Also shown is the switch connecting wiring 34 and the switch 18 as well as the cover ring 13 with the intake ports 132.

Figure 15:
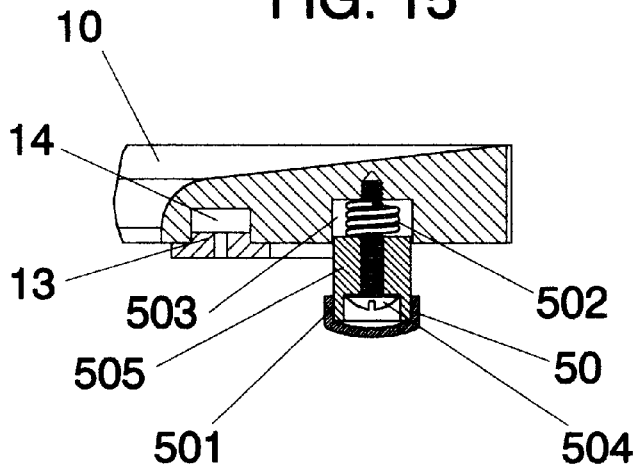

FIG. 15 illustrates a cross-section view of the spring style standoff 50 comprising a cap 501, a spring 502, a screw 504, and a plunger 505. The screw 504 is inserted through the plunger 505, through the spring 502, and into the toilet seat 10. The plunger 505 fits into and is moveable within a clearance 503 in the toilet seat 10. The spring 502 exerts a bias force against the commode 40 when the seat is lowered, which, upon proper adjustment of the screw 504 and with the spring 502, prevents actuation of the switch 18 unless a person is seated on said toilet seat 10. Also shown in FIG. 15 is the cover ring 13 in the vacuum channel 14 in said toilet seat 10. The spring style standoff 50 is an alternative to rubber standoff 19.

Figure 16:
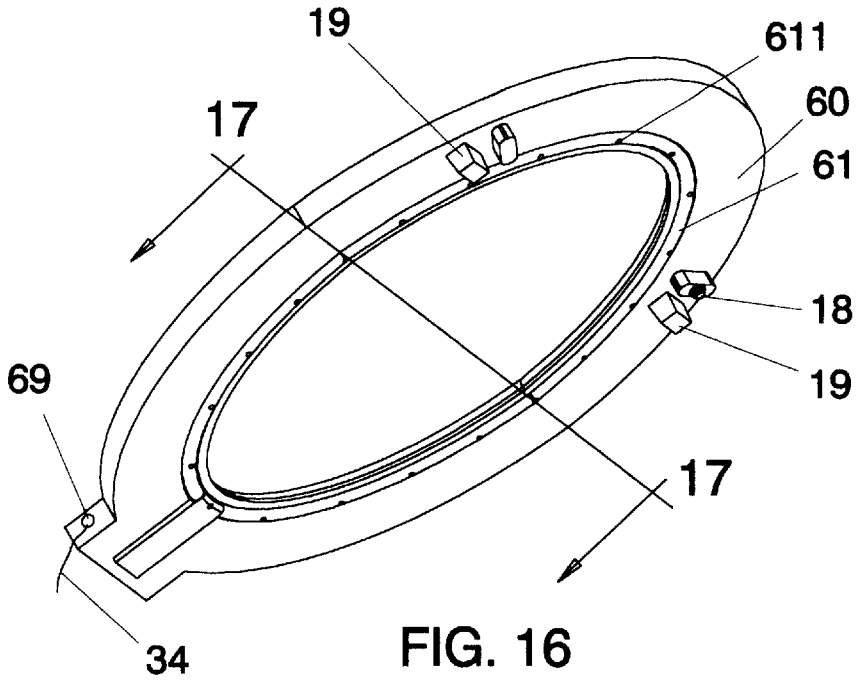
FIGS. 16, 17, and 18 illustrate an alternate embodiment seat assembly.
Figure 17:
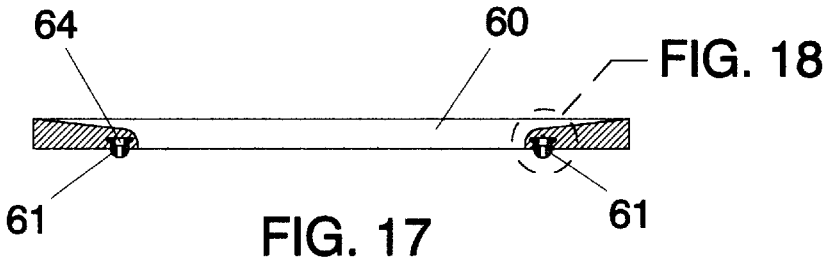
Figure 18:
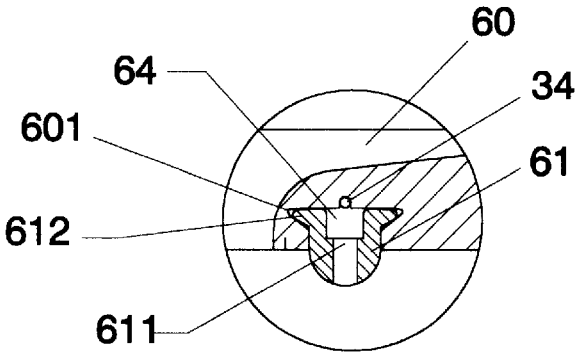

FIGS. 16, 17, and 18 illustrate an alternate embodiment toilet seat 60 comprising a press in cover ring 61 with alternate embodiment inlet ports 611, an alternate vacuum channel 64, at least one retaining undercut 601 which is shown in FIG. 18, an alternate embodiment exhaust, hinge, and wiring clearance 69, rubber standoffs 19, and the switch 18. Switch connecting wiring 34 is shown entering said clearance 69 and in said vacuum channel 64.

FIGS. 19, 20, and 21 illustrate a second alternate embodiment toilet seat 70 comprising an alternate embodiment press in cover ring 71 with second alternate embodiment inlet ports 711, a second alternate embodiment vacuum channel 74, a second alternate embodiment exhaust, hinge, and wiring clearance 72, rubber standoffs 19, and the switch 18. A purpose of the rubber standoffs 19 is to protect the switch 18 from impact loads such as can be expected from slamming said toilet seat 10 or from a person falling on said toilet seat 10. Another purpose of the rubber standoffs 19 is to prevent the full weight of a person being borne by the switch 18. The previously mentioned standoff 50 serves the same purposes. The switch connecting wiring 34 is shown entering said clearance 72 and in said vacuum channel 74.

Figure 22:
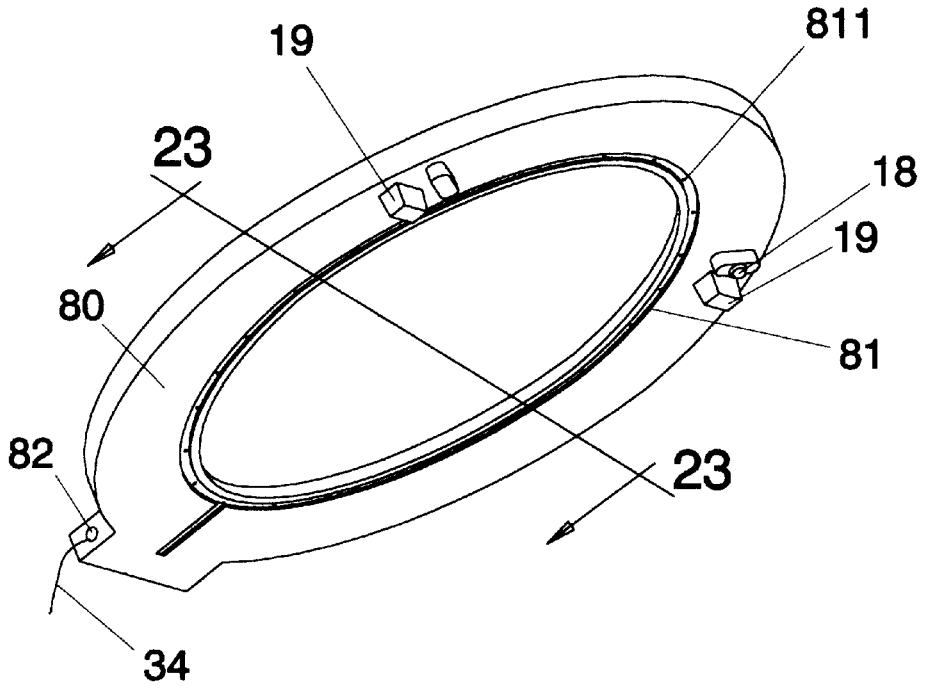
FIGS. 22, 23, and 24 illustrate a third alternate embodiment seat assembly.
Figure 23:
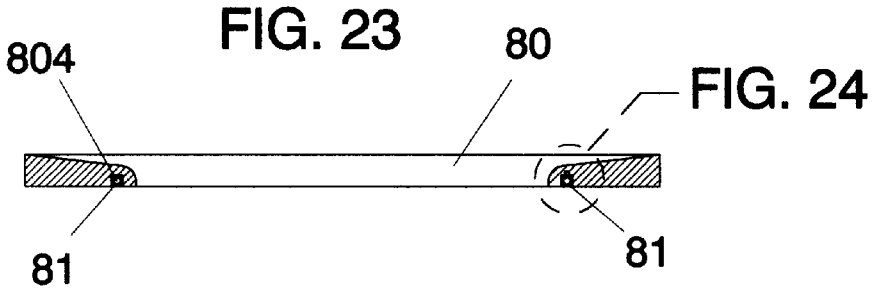
Figure 24:
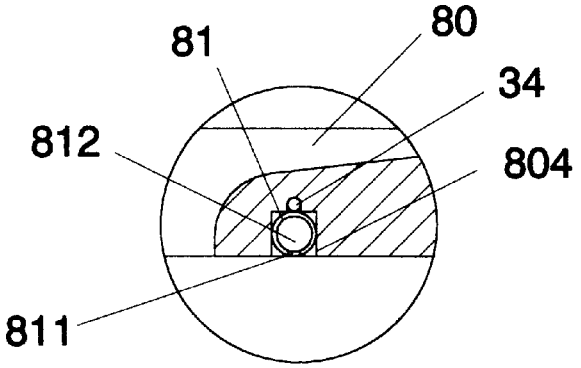

FIGS. 22, 23, and 24 illustrate a third alternate embodiment toilet seat 80 comrprising a hose assembly groove 804, vacuum hose 81 with ports 811, rubber standoffs 19, and a third alternate embodiment exhaust, hinge, and wiring clearance 82, and the switch 18. The interior area 812 of the vacuum hose 81 serves as a vacuum channel. The hose assembly groove 804 is cut or formed into said seat 80 so that said vacuum hose 81 is held in position. As in the case of cover ring 13 with intake ports 132 with respect to the toilet seat 10, the hose assembly groove 804 is located in the toiled seat 80 so the ports 811 are positioned inside of the inner rim of the commode 40 for easy draft for removing noxious vapors from said commode 40. The switch connecting wiring 34 is shown entering said clearance 82 and in said groove 804.

Figure 25:
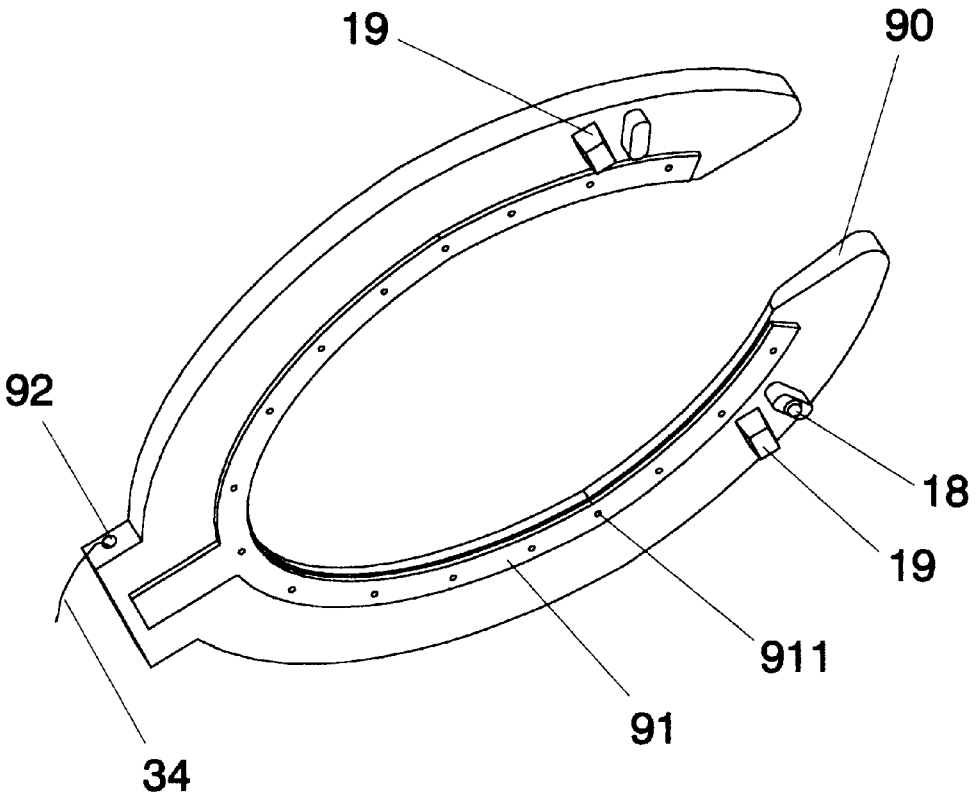
FIG. 25 illustrates an open seat assembly.

FIG. 25 shows a fourth alternate embodiment toilet seat 90, which is an open ended toilet seat, with open seat press in cover ring 91 with fourth alternate embodiment inlet ports 911, rubber standoffs 19, the switch 18, and a fourth alternate embodiment exhaust, hinge, and wiring clearance 92. The switch connecting wiring 34 is shown entering said clearance 92.

To generalize, FIGS. 26, 27, 28, and 29 illustrate a fifth alternate embodiment of the present invention which is different in that a hollow hinge stud 21A is used in conjunction with a hinge stud clearance 27A as a means of mounting a toilet seat on a commode and providing a channel for switch connecting wiring 34 and exhaust fumes.

Figure 26:
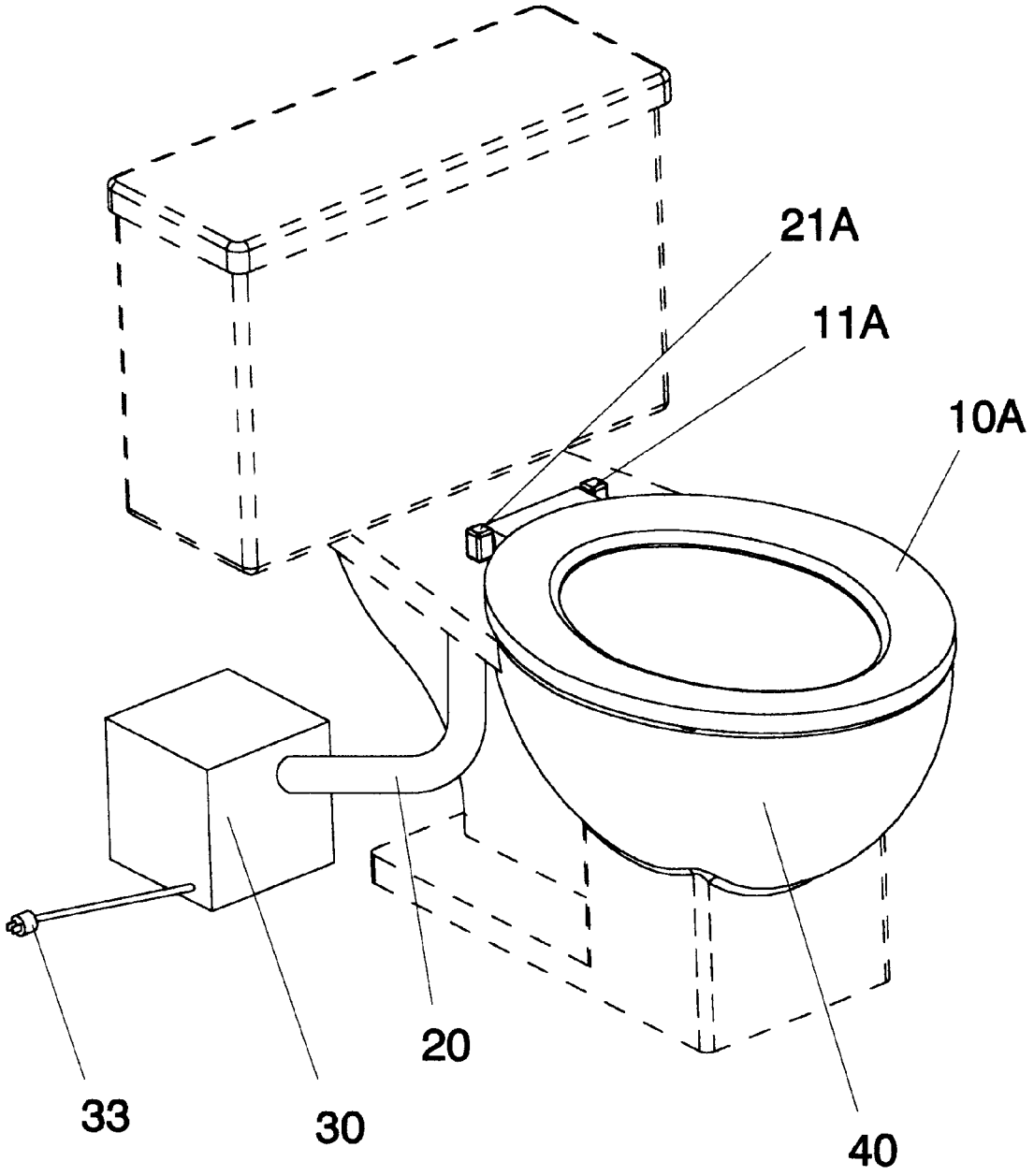
FIG. 26 illustrates an alternate embodiment seat and hinge assembly.

To be specific, FIG. 26 shows a fifth alternate embodiment of the present invention installed on a prior art commode 40 comprising a fifth embodiment seat 10A with alternate mount 11A, hollow mount 21A, exhaust hose 20, exhaust fan unit 30, and electrical power supply wiring 34.

FIG. 27 shows the fifth alternate embodiment seat 10A with rubber standoffs 19, switch 18, cover ring 13 with intake ports 132, hollow hinge stud 12A, and the switch connecting wiring 34 wherein the switch connecting wiring 34 is entering the hollow hinge stud 12A.

FIGS. 28 and 29 show details of the hollow mount 21A comprising an alternate threaded mount tube 210A and the hinge stud clearance 27A.

Figure 30:
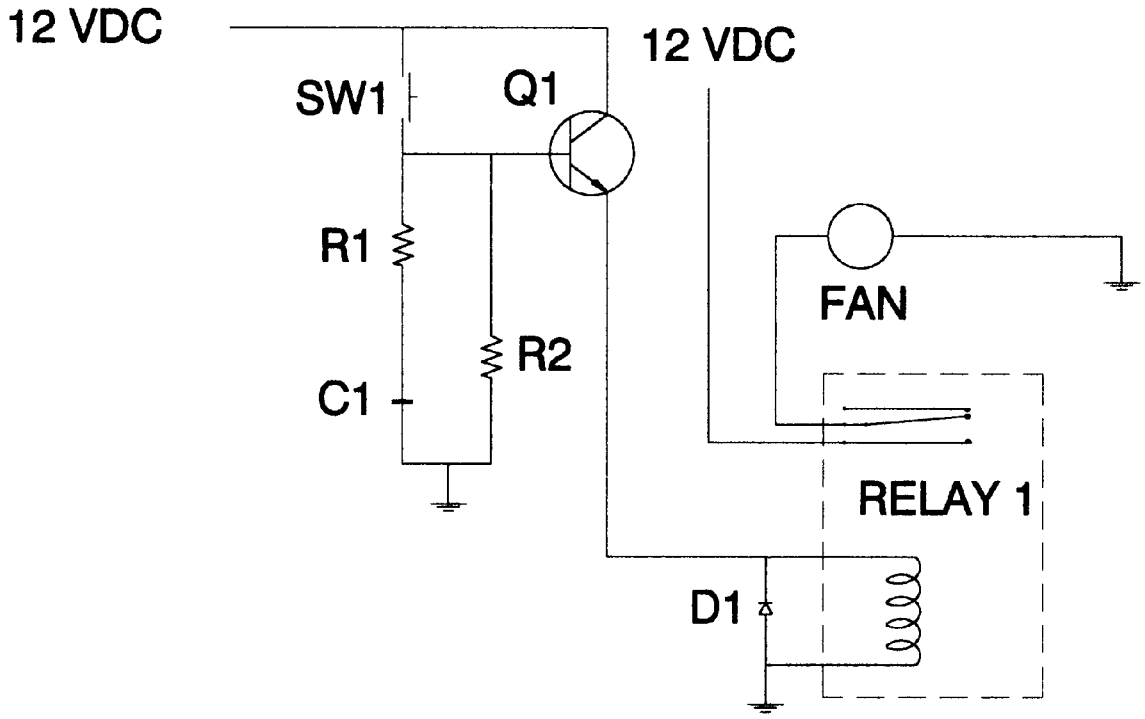
FIG. 30 is a circuit for operation of the invention with 12 volt direct current electricity.

FIG. 30 is a circuit that permits the use of the present invention in installations where only 12 volt DC electricity is available. This is common in the mobile home and travel trailer industry. FIG. 30 differs from FIG. 13 in that a transfomer and rectifier is not required in FIG. 30. This would be applicable to a fan powered by a 12 volt DC motor.

As shown in FIG. 30, when SW1, i.e. switch 18 is closed current is applied to the base of the transister Q1 allowing current flow across a collector-emitter junction of said tansister Q1. This current actuates a normally open RELAY 1 that controls a fan powered by a 12 volt DC motor. Simultaneously, current is allowed to pass through a resister R1 and be applied to a positive plate of a capacitor C1. The capacitor C1 stores the charge on said positive plate of C1 which is built up from the current flow, until a saturation level as allowed by the capacitance of C1 is reached.

In FIG. 30, as in FIG. 13, when SW1, i.e. switch 18, is opened, as when happens with the removal of said sufficient weight on a toilet seat, such as seat 10, with a switch 18, to actuate SW1, the charge stored in capacitor C1 is allowed to discharge through a resistor R2. This causes a positive potential to be maintained at the base of said transistor Q1, allowing current flow through said collector-emitter junction of said transistor Q1 to continue. When the stored charge in capacitor C1 goes below the level required to maintain the current flow in the transistor Q1, said transistor Q1 acts like a switch that is turned off and causes said RELAY 1 to stop passing 12 volts DC to the fan. Effectively, this has caused a delay in the fan, being turned off after said sufficient weight to activate SW1 has been removed from said seat. A diode D1 is shown which dampens a release pulse generated by the RELAY R1 when the Relay R1's coil is de-energized.

As in FIG. 13, the delay obtainable is a variable based on the actual values of the resistor R2 and the capacitor C1.

As in FIG. 13, the circuit shown in FIG. 30 isolates the SW1, i.e. switch 18, from the current supplied to the fan. As in FIG. 13, the current involved in the circuit affecting the SW1 is less than 300 milliamps. This is an advantage over the prior art discussed in the background information section of this application.

What is common to the various seat embodiments illustrated and discussed is a toilet seat incorporating a channel, i.e. a recess, that can be modified from a standard toilet seat common to the trade during molding or by machining operations after molding, a cover ring or a vacuum hose with ports that presses into said channel. The combination of a channel and a cover ring with intake ports serves as a conduit for exhausting air with noxious fumes as well as a conduit for the switch electrical wiring 34. The hose 81 with ports 181 also forms a conduit for exhausting air with noxious fumes. The hose 81 is pressed into a channel. Switch connecting wiring is run into said seat, through said channel, and connected to the switch 18 that has been added to said seat. Standoffs, such as rubber standoffs 19 or the spring style standoff 50 are used so as to hold said seat off of the switch 18 until someone sits on said toilet seat. The switch 18 is activated, which causes the previously discussed circuit to start the fan 321, which draws air through inlet holes in the cover ring or vacuum hose, and such noxious fumes as may be caused by a person using a commode utilizing this invention are drawn from the commode so they can be exhaused from the area. Having a low current, low voltage circuit in the region of a person, as does this invention, is an advantage over prior art. Having a simple seat with cover ring or vacuum hose arrangement has a number of advantages over prior art. It is simpler to fabricate, easier to replace parts, such as the cover ring or vacuum hose, and much easier to keep clean.

The various toilet seats discussed in this application are modifications of a commercially available toilet seat, Model 420-H from Beneke Division, Sanderson Plumbing Products, Inc., Columbus, Miss., 38703. The various channels discussed can be either machined into said Model 420-H, or they could be formed from modified Model 420-H production tooling in the event this was justified by market demand.

The various cover rings disclosed are manufacturable from a flexible plastic, such as a urethane plastic, or a rubber, or some other suitable material.

All other parts can be made of suitable materials known to the plumbing trade.

Among the advantages of these embodiments are drainage and cleanability, as can be seen from the drawings. Another major advantage is that the switch electrical wiring 34 is passing only a low current of 50 to 300 milliamps at approximately 12 volts DC or less, which is desirable from a safety standpoint due to the sensitive body parts in the vicinity of the toilet seat 1.

Although the description above contains many specificities, these should not be construed as limiting the scope of the invention but as merely providing illustrations of some of the presently preferred embodiments of this invention.

For example, the switch 18 can be located in other areas of a toilet seat. Also, while in FIGS. 1 and 26 the fan unit 30 is shown in the vicinity of the commode 40, said fan unit 30 would typically be back in a wall or ceiling, away from risk of flooding in the event of the commode 40 overflowing.

Thus the scope of the invention should be determined by the appended claims in the formal application and their legal equivalents, rather than by the examples given.

I claim:

1. An odor removal system for removing noxious vapors from a commode comprising:

a) a toilet seat comprising a conduit for exhausting noxious vapors, and a hollow seat mount;

b) an exhaust hose;

c) a fan driven by an electric motor; and d) an electric circuit comprising:

a switch that is activated when a person sits on said toilet seat;

wiring connected to said switch and routed through said conduit;

a first resistor;

a capacitor;

a second resistor;

a transistor;

a diode; and a normally open relay;

wherein, when said switch is closed, current is applied to a base of said transistor allowing current flow across a collector-emitter junction of said transistor, said current actuating said normally open relay that controls said motor driving said fan to operate said fan and draw noxious vapors from said commode, through said conduit, hollow seat mount, and exhaust hose, and through said fan, while current is allowed to pass through said first resistor and to be applied to a positive plate of said capacitor until a saturation level allowed by the capacitance of said capacitor is reached;

wherein when said switch is subsequently opened, the charge stored in said capacitor is allowed to discharge through said second resistor which causes a positive potential to be maintained at the base of said transistor, allowing current flow through said collector-emitter junction of said transistor to continue, until the stored charge in said capacitor goes below a level required to maintain the current flow in said transistor, whereupon said transistor acts as a switch that is turned off and causes said normally open relay to stop passing current to said motor, said allowance of current flow causing a delay in said fan being turned off after said switch is opened, wherein said diode dampens a release pulse generated by said relay when said relay is deenergized.

2. The odor removal system of claim 1 wherein said conduit for exhausting noxious fumes comprises:

a) a cover ring with ports and b) a channel in said seat wherein the cover ring is pressed into said channel and said conduit is formed.

3. The odor removal system of claim 2 wherein said cover ring with ports is located in said toilet seat so said ports are positioned inside of an inner rim of said commode when said toilet seat is lowered.

4. The odor removal system of claim 1 wherein said conduit for exhausting noxious fumes comprises a hose with ports which is pressed into a channel in said seat.

5. The odor removal system of claim 4 wherein said channel is located in said toilet seat so said hose with ports is positioned inside of an inner rim of said commode when said toilet seat is lowered.

6. The odor removal system of claim 1 wherein said toilet seat further comprises at least one standoff, separate from said switch.

7. The at least one standoff of claim 6 wherein the standoff protects the switch from impact loads.

* * * * *